US009441910B1

(12) United States Patent
Fogoros

(10) Patent No.: US 9,441,910 B1
(45) Date of Patent: Sep. 13, 2016

(54) ADJUSTABLE GUN HAND GRIP

(71) Applicant: Steven J. Fogoros, Fort Worth, TX (US)

(72) Inventor: Steven J. Fogoros, Fort Worth, TX (US)

(73) Assignee: Steven J. Fogoros, Fort Worth, TX (US)

( * ) Notice: Subject to any disclaimer, the term of this patent is extended or adjusted under 35 U.S.C. 154(b) by 0 days.

(21) Appl. No.: 14/938,620

(22) Filed: Nov. 11, 2015

Related U.S. Application Data

(60) Provisional application No. 62/078,149, filed on Nov. 11, 2014.

(51) Int. Cl.
*F41C 23/16* (2006.01)
*F41C 23/14* (2006.01)

(52) U.S. Cl.
CPC ..... *F41C 23/14* (2013.01); *F41C 23/16* (2013.01)

(58) Field of Classification Search
CPC ..... F41A 11/00; F41A 11/02; F41A 11/04; F41C 23/00; F41C 23/10; F41C 23/12; F41C 23/14; F41C 23/16
USPC ..... 42/71.02, 71.01, 72; 89/1.42
See application file for complete search history.

(56) References Cited

U.S. PATENT DOCUMENTS 842,436 A * 1/1907 Thomas ..... F41C 23/14 42/73
1,248,029 A * 11/1917 Snedecor et al. ..... F41C 23/14 42/73
1,468,354 A * 9/1923 Caretto ..... F41C 23/14 42/74
1,583,616 A * 5/1926 Smith ..... F41C 23/00 42/75.03
2,066,218 A * 12/1936 Morgan ..... F41C 23/14 42/73
3,323,246 A * 6/1967 Loffler ..... F41A 11/00 192/13 A
3,380,182 A * 4/1968 Browning ..... F41A 3/66 42/75.03
4,300,302 A * 11/1981 Anschutz ..... F41C 23/14 42/73
6,250,009 B1 * 6/2001 Leontuk ..... F41A 27/22 42/72
6,487,807 B1 * 12/2002 Kopman ..... F41A 23/12 42/72
7,322,142 B1 * 1/2008 Leung ..... F41C 23/04 42/71.01
7,464,495 B2 * 12/2008 Cahill ..... F41C 23/12 42/72
7,533,597 B1 * 5/2009 Strohman ..... F16C 11/10 403/150
7,584,568 B1 * 9/2009 Brownlee ..... F41C 23/16 42/94
8,601,734 B1 * 12/2013 Hopkins ..... F41C 23/14 42/71.01
8,720,099 B1 * 5/2014 Sisk ..... F41C 23/14 42/73
8,839,545 B1 * 9/2014 Gangl ..... F41A 11/00 42/75.03
2002/0005005 A1 * 1/2002 Miller ..... F41A 11/00 42/75.02

(Continued)

*Primary Examiner* — Bret Hayes
*Assistant Examiner* — Derrick Morgan
(74) *Attorney, Agent, or Firm* — Eldredge Law Firm; Richard Eldredge

(57) ABSTRACT

A gun system includes a gun body; a hand grip rotatably attached to the gun body; and an attachment device rigidly attached to the gun body and to the hand grip. The hand grip is secured solely to the gun body via the attachment device and the attachment device is configured to allow movement of the hand grip relative to the gun body.

8 Claims, 8 Drawing Sheets

(56) References Cited

U.S. PATENT DOCUMENTS

2003/0221352 A1* 12/2003 Steele ..... F41C 23/14 42/73
2006/0191183 A1* 8/2006 Griffin ..... F41C 23/16 42/72
2009/0126249 A1* 5/2009 Crommett ..... F41A 11/02 42/71.01
2009/0193702 A1* 8/2009 Lin ..... F41C 23/16 42/72
2009/0313873 A1* 12/2009 Roth ..... F41C 23/16 42/72
2010/0084524 A1* 4/2010 Faifer ..... F16M 11/04 248/170
2010/0146835 A1* 6/2010 Mc Nulty, Jr. ..... F41B 15/04 42/1.08
2010/0307043 A1* 12/2010 Moody ..... F41A 23/08 42/72
2012/0096755 A1* 4/2012 Griffin ..... F41C 23/14 42/105
2012/0272557 A1* 11/2012 Yan ..... F41C 23/12 42/69.01
2013/0185895 A1* 7/2013 Daniel ..... F41C 27/00 16/2.1
2013/0239450 A1* 9/2013 Michel ..... F41C 23/14 42/73
2013/0333263 A1* 12/2013 Hovey ..... F41C 23/16 42/72
2013/0340312 A1* 12/2013 Fulton ..... F41C 23/14 42/73
2015/0219416 A1* 8/2015 Chvala ..... F41C 23/04 42/71.01
2016/0003576 A1* 1/2016 Spykerman ..... F41C 23/10 42/73

* cited by examiner

ADJUSTABLE GUN HAND GRIP

BACKGROUND

1. Field of the Invention

The present invention relates generally to guns, and more specifically, to gun hand grips.

2. Description of Related Art

Gun hand grips are well known in the art and are effective means to securely hold and manipulate a handgun or rifle. In FIG. 1, a simplified side view of an assault rifle 101 is shown having a hand grip 103 secured to the body 105 of the rifle 101. An exploded partial view of rifle 101 is shown in FIG. 2. As shown in the two figures, the hand grip 103 is fixedly attached to the body 105 of the rifle. Thus, the hand grip 103 does not move in the X, Y, Z, axes independently of the rifle body 105, wherein the X-axis runs along the longitudinal length of the rifle, Y-axis is 90 degrees relative to the X-direction, and the Z-axis is 90 degrees and transverse from the X-direction.

One commonly known disadvantage of having a fixed hand grip is requiring the shooter to awkwardly position the hand and arm in an unnatural and uncomfortable orientation. The limited use of a fixed hand grip is a significant disadvantage.

Although great strides have been made in the area of gun hand grips, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
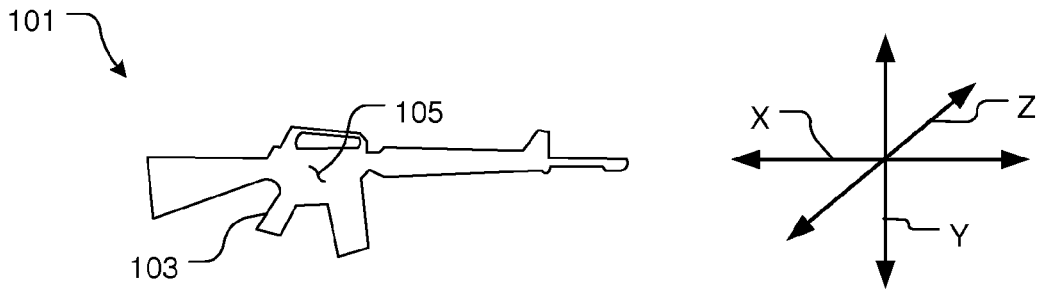
FIG. 1 is a side view of a conventional rifle.
Figure 2:
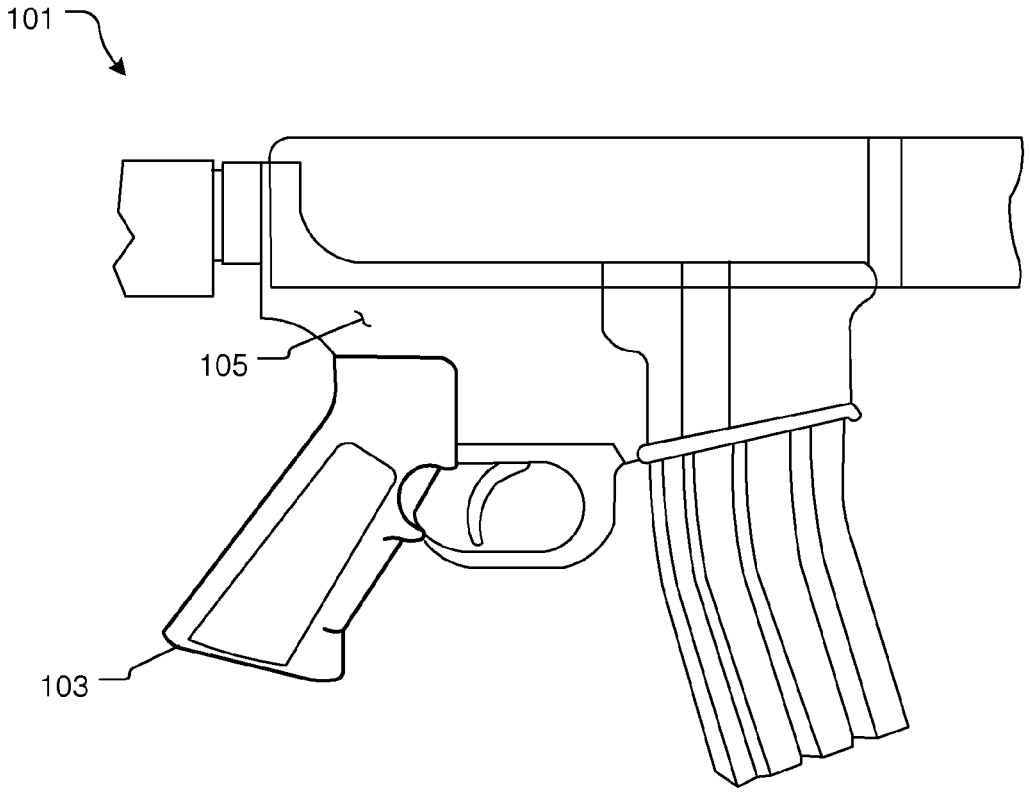
FIG. 2 is an exploded side view of the rifle of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional gun systems. Specifically, the system of the present application is a gun configured to provide rapid and effective means to adjust the hand grip, thereby increasing the comfort to the shooter. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3:
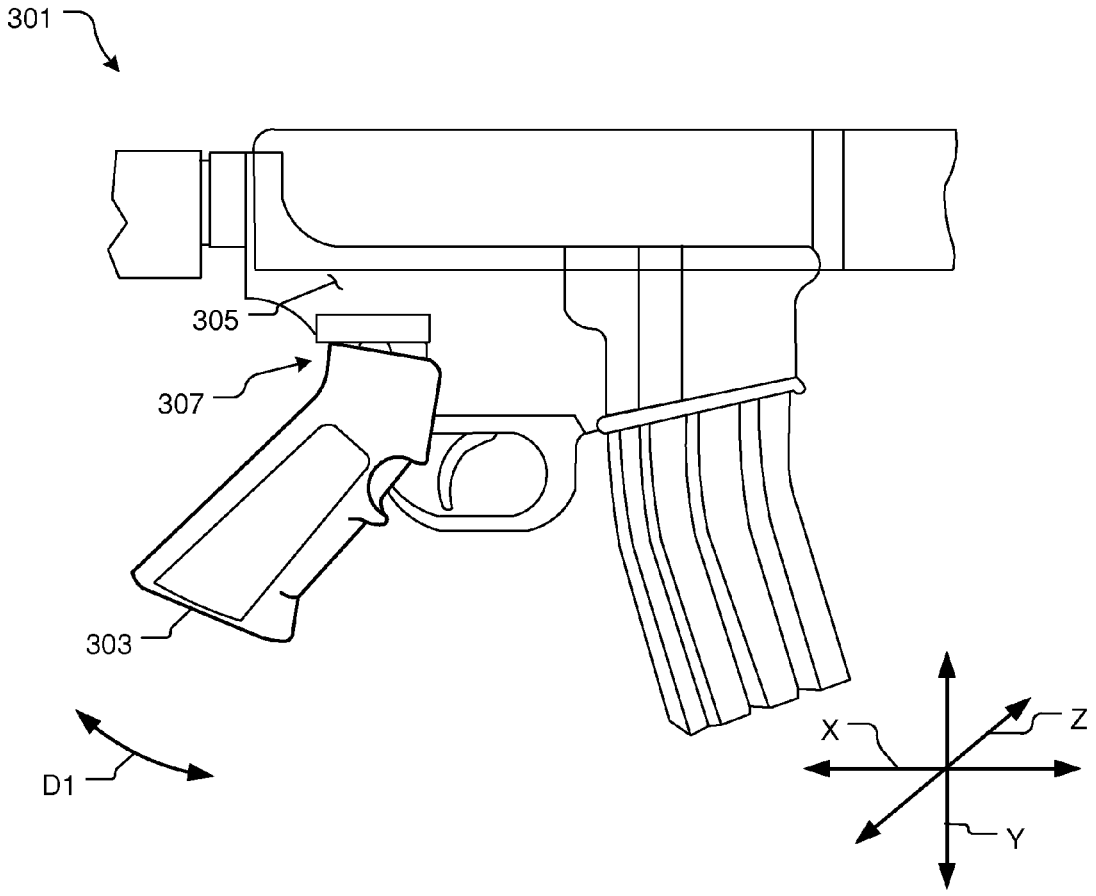
FIG. 3 is a side view of a rifle in accordance with a preferred embodiment of the present application.

Referring now to the drawings wherein like reference characters identify corresponding or similar elements throughout the several views, FIG. 3 depicts a simplified front view of a gun system 301 in accordance with a preferred embodiment of the present application. It will be appreciated that the system 301 overcomes one or more of the above-listed problems commonly associated with conventional handgrips for guns.

In the exemplary embodiment, system 301 is a rifle; however, it will be appreciated that the features discussed herein could also be incorporated with other types of handguns and/or other types of devices that utilize handgun grips.

In the contemplated embodiment, system 301 includes a handgun grip 303 that is adjustably attached to the body 305 of the rifle via a locking mechanism 307. In the exemplary embodiment, the hand grip 303 is adapted to move in direction D1 and locked into the stationary position via a locking mechanism 409, which is further discussed below.

Figure 4:
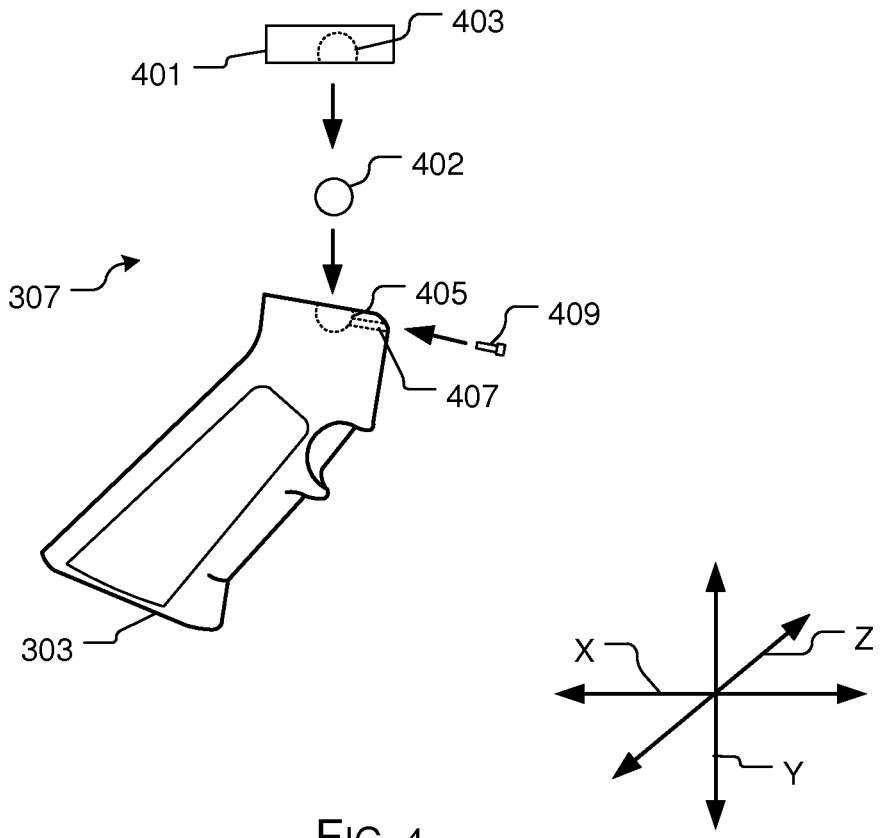
FIG. 4 is a side view of the hand grip of FIG. 3.

In FIG. 4, the features of hand grip 303 are shown. It will be appreciated that locking mechanism 307 includes a base 401 that secures to the body 305 and a spherical cavity 403 disposed therein for receiving a ball 402. The ball is also received within a cavity 405 disposed within the hand grip 303. The ball 402 is secured in position with a threaded fastener 409 that engages and extends through a threaded shaft 407 extending through the hand grip 303 and in communication with the cavity 405. During use, the fastener 409 is configured to secure the hand grip 303 in the desired orientation relative to the body 305.

It will be appreciated that the unique features believed characteristic of the present application include the ability to rotate, pivot, and slide the hand grip 303 relative to axes X, Y, and Z. This feature allows the user to more comfortably adjust the wrist while operating the gun. The locking mechanism enables the user to retain the hand grip in the desired orientation relative to the gun body.

Figure 5:
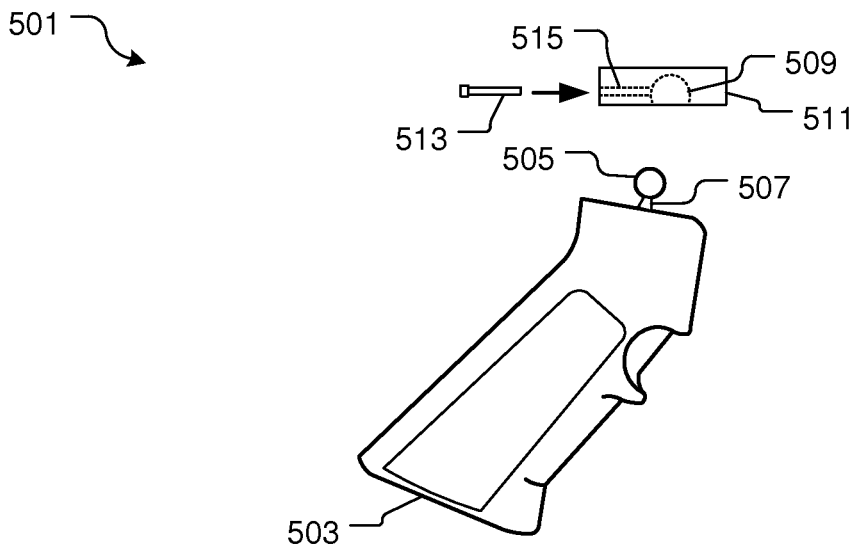
FIG. 5 is a side of a hand grip in accordance with an alternative embodiment of the present application.

It should be understood that locking mechanism 307 is one of many different embodiments contemplated to achieve the desired features of orienting and fixing the hand grip in a desired position. Alternative embodiments are also contemplated. For example, FIG. 5 depicts a system 501 having a hand grip 503 operably associated with a locking mechanism that includes a ball 505 fixedly attached to the hand grip via a shaft 507 and configured to engage within a cavity 509 disposed within a base 511. Base 511 securely attaches to the body 305 of the gun and the ball is secured in the desired position via a fastener 513 that threadingly engages with channel 515. These and other locking mechanisms are contemplated.

Figure 6:
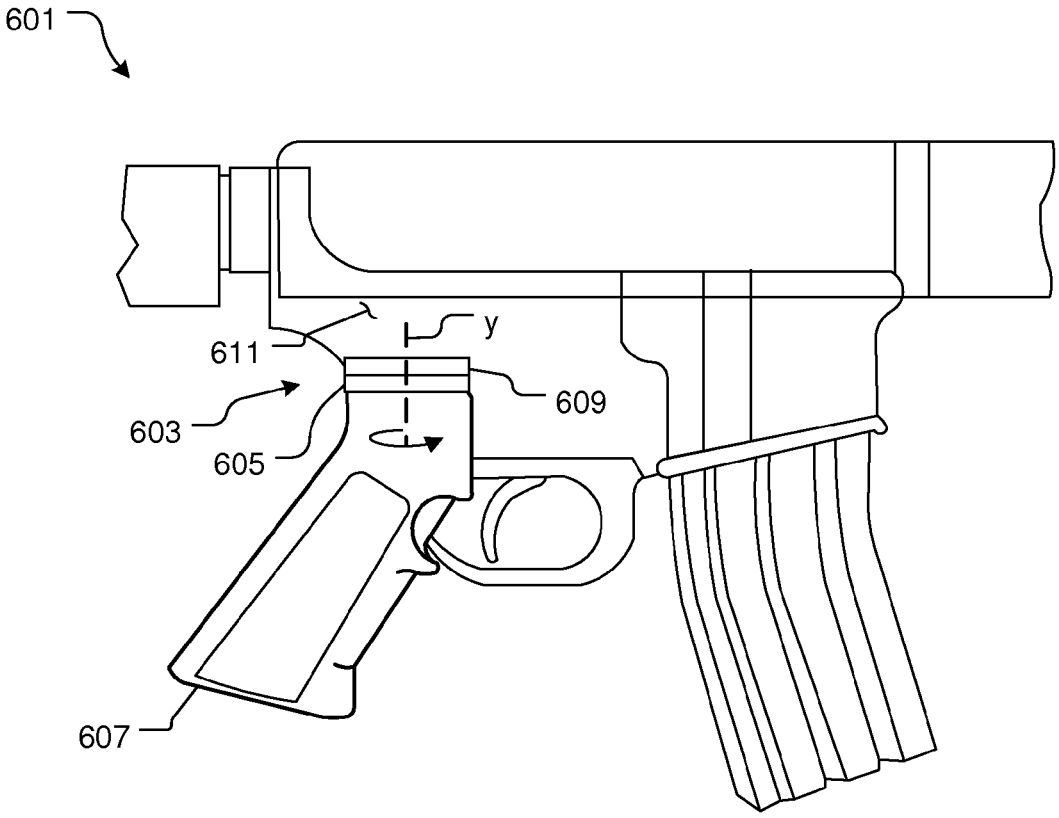
FIG. 6 is a side view of a handgun grip in accordance with an alternative embodiment.
Figure 7:
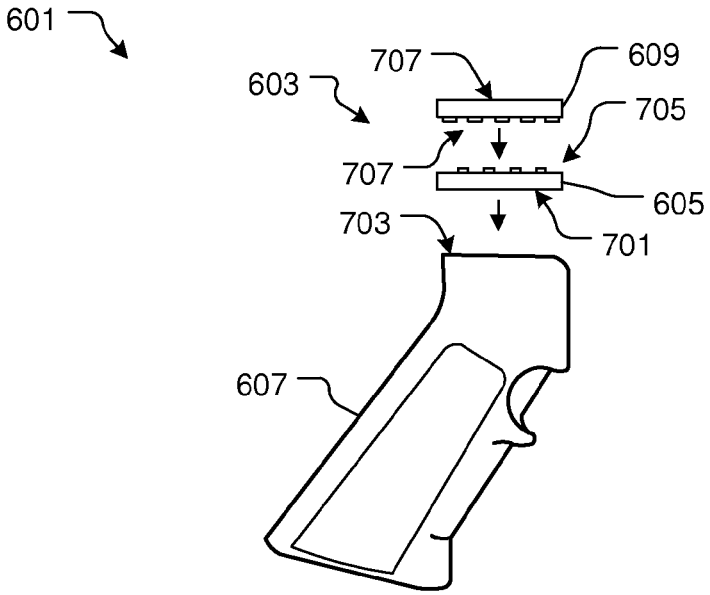
FIG. 7 is a side view of the handgun grip of FIG. 6.
Figure 8:
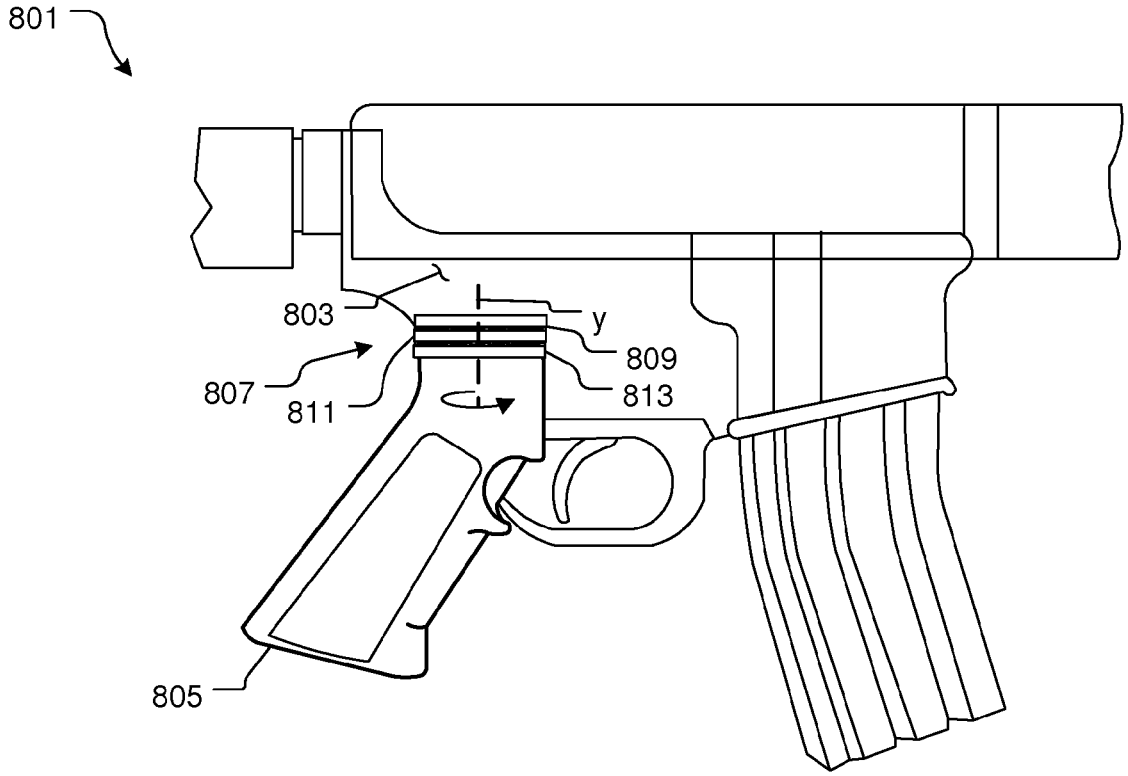
FIG. 8 is a side view of an alternative embodiment.

In FIGS. 6 and 7, an alternative embodiment is shown that include one or more of the features discussed above. It will be appreciated that system 601 includes a locking mechanism 603 contemplated to merely allowing rotating and locking of the hand grip 607 in a fixed position relative to body 611 along y-axis. In the exemplary embodiment, locking mechanism includes two members 605, 609 adapted to join together.

In FIG. 7, the hand grip member 605 has a body with a first surface 701 configured to rigidly secure to a top surface of the hand grip 607 and member 609 having a first surface 707 configured to rigidly secure to the body 611 of the gun. The member 605 includes a plurality of teeth 705 adapted to engage with teeth 707 of member 609. During use, the teeth 705 and 707 are used to secure the hand grip 607 in the desired orientation along the y-axis.

Referring now to FIGS. 8-11, various views of a system 801 is shown in accordance with an alternative embodiment. System 801 is substantially similar in form and function to the above-described systems and incorporates one or more of the features discussed herein.

In the contemplated embodiment, system 801 includes a gun body 803 and a grip 805 rotatably attached to body 803 via an attachment device 807. During use, the attachment device 807 enables rotation of the grip 805 relative to the body along the identified y-axis. This feature allows selective rotation of the grip for better handling preference.

Figure 9:
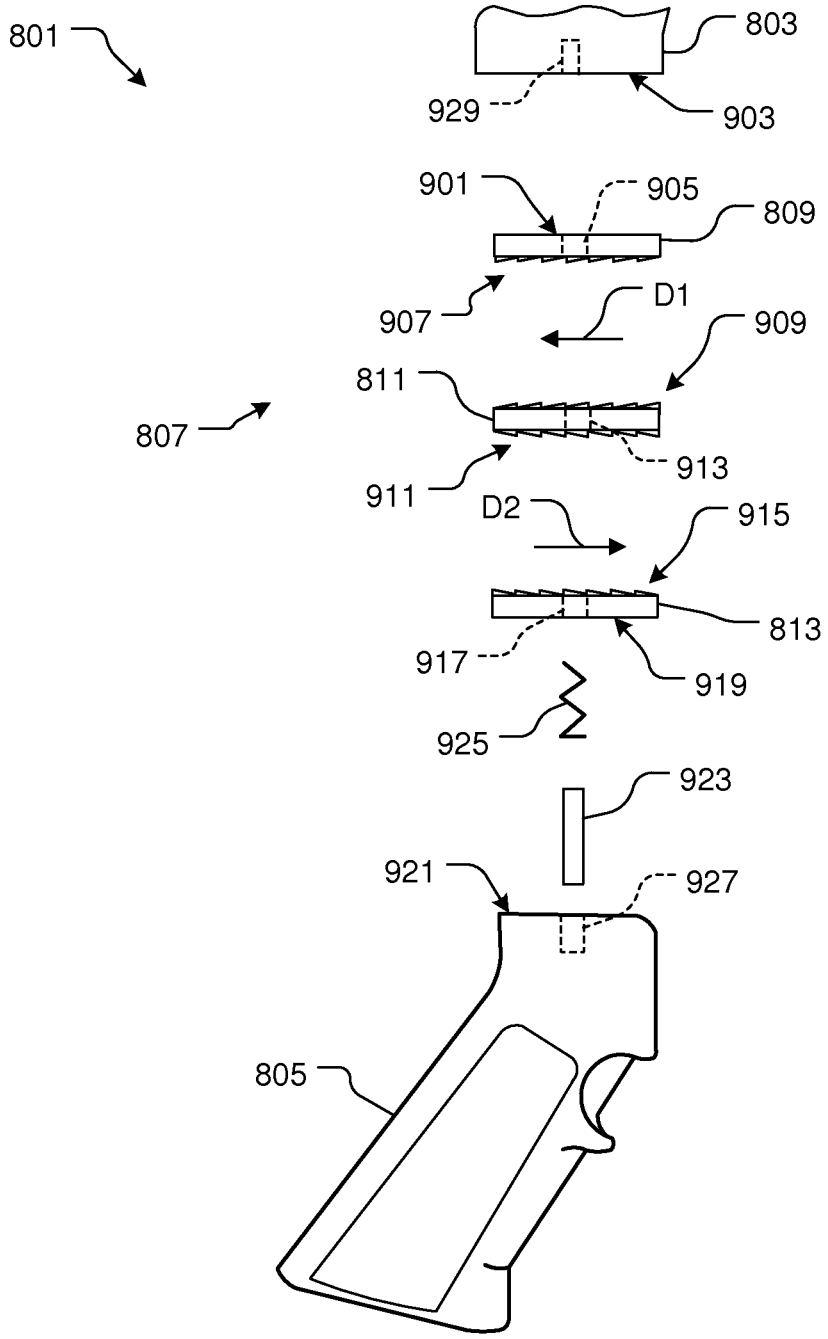
FIG. 9 is a disassembled view of the alternative embodiment of FIG. 8.

Attachment device 807 preferably includes an upper disc 809, a middle disc 811, and a lower disc 813 removably joined together via a pin 923 and spring 925 (see e.g., FIG. 9). During use, the discs will separate from each other, rotate about the pin 923, and rejoin together via the compression force created by spring 925.

In FIG. 9, a partial disassembled view of system 801 is shown for further clarity. Upper disc 809 includes a top surface 901 configured to abut against a gun body surface 903. Disc 809 is further provided with a hole 905 extending through the thickness and adapted to receive pin 923 and a plurality of angled teeth 907 configured to rotatably engage with a plurality of teeth 909 on middle disc 811.

Disc 811 is provided with a plurality of teeth 909 along a top surface and a plurality of teeth 911 along a bottom surface. Disc 811 is further provided with a hole 913 extending through the thickness of disc 811 and configured to receive pin 923 therethrough. The plurality of teeth 911 are configured to receive and lock with a plurality of teeth 915 extending from a surface of disc 813.

Disc 813 includes a hole 917 extending through the thickness and configured to receive pin 923 therethrough. Disc 813 is further provided with a lower surface 919 configured to abut against a top surface 921 of grip 805.

As discussed, the contemplated embodiment utilizes a pin 923 and spring 925 to allow selective adjustment of the discs 809, 811, and 813 relative to each other. When assembled, the spring 923 is configured to extend around the outer periphery of the pin 923 and both the pin and spring are configured to pass through the holes 917, 913, and 905 and configured to engage with an opening 929 of body 803 and an opening 927 of grip 805.

One of the unique features believed characteristic of attachment device 807 is orienting the teeth in opposing angles A1, A2, A3, and A4 relative to each other and relative to the y-axis. Accordingly, the plurality of teeth are oriented such that teeth 907, 909 rotate relative to each other in direction D1, and teeth 911, 915 rotate relative to each other in the opposing direction D2.

Figure 10:
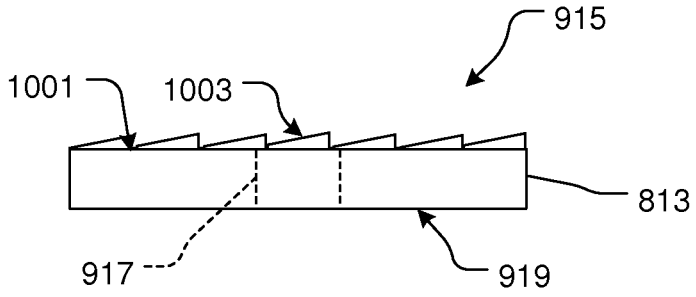
FIGS. 10 and 11 are side views of the disc of FIG. 8.
Figure 11:
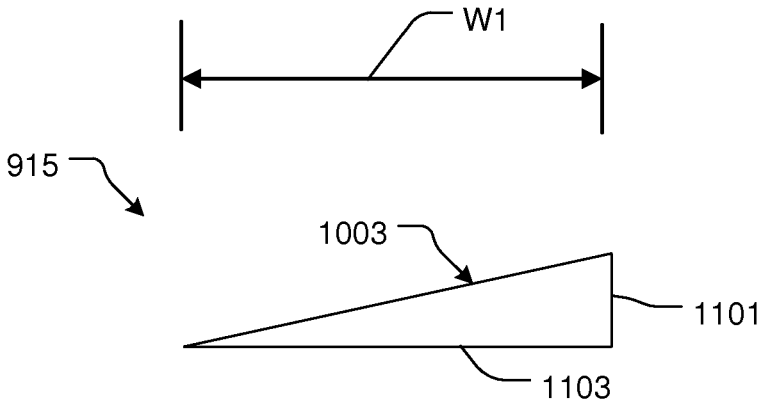

Referring to FIGS. 10 and 11, front views of disc 813 and teeth 915 are shown. Teeth 915 include an upper angled straight surface 1003 angled at an angle relative to surface 1001. The teeth 915 have a vertical side 1101 integral with a bottom horizontal side 1103 and surface 1003. During use, vertical side 1101 prevents rotation of the discs relative to each other. The bottom side 1103 has a width W1. In the contemplated embodiment, the teeth discussed herein all have the same features of teeth 915. Accordingly, it is contemplated having the same width W1 for the teeth.

Figure 12:
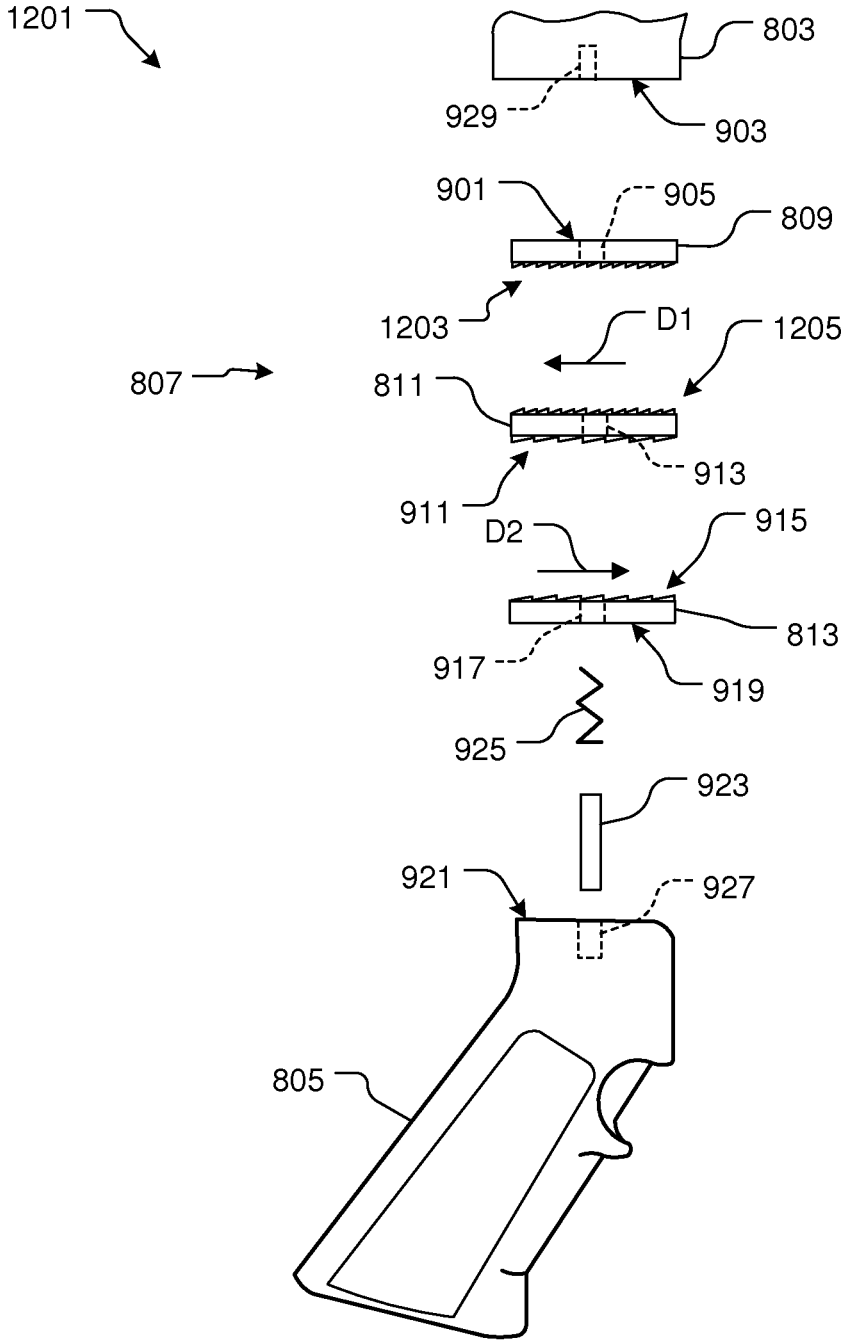
FIG. 12 is a disassembled view of an alternative embodiment.

However, as shown in FIG. 12, an alternative embodiment 1201 could include 1203, 1205 configured to have different widths than teeth 911, 915. This feature could be utilized for greater rotational adjustments of the discs relative to each other.

The particular embodiments disclosed above are illustrative only, as the embodiments may be modified and practiced in different but equivalent manners apparent to those skilled in the art and having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A gun system, comprising:

a gun body;

a hand grip rotatably attached to the gun body; and an attachment device rigidly attached to the gun body and to the hand grip;

the attachment device comprising:

a first disc;

a second disc;

a middle disc disposed between the first disc and the second disc;

a first set of teeth extending from the first disc;

a second set of teeth extending from the second disc;

wherein the first set of teeth and the second set of teeth rotatably engage with each other and retain the first disc to the second disc;

wherein the first disc is configured to engage with the gun body and the second disc is configured to engage with the hand grip;

wherein the first disc rotates relative to the second disc;

wherein the first disc and second disc rotate relative to the middle disc; and wherein the hand grip is secured solely to the gun body via the attachment device; and wherein the attachment device is configured to allow movement of the hand grip relative to the gun body.

2. The system of claim 1, wherein the attachment device is configured to allow rotational movement of the hand grip relative to the gun body.

3. The system of claim 1, further comprising:

a pin configured to extend through the first disc and the second disc;

wherein the pin rigidly secures to the gun body and the hand grip; and wherein the first disc and the second disc rotate relative to the pin.

4. The system of claim 3, further comprising:

a spring configured to extend around the pin and configured to create a locking force to secure the first disc against the second disc.

5. The system of claim 1, further comprising:

a pin configured to extend through the first disc, the second disc, and the middle disc;

wherein the pin rigidly secures to the gun body and the hand grip; and wherein the first disc, second disc and the middle disc rotate relative to the pin.

6. The system of claim 1, further comprising: a spring configured to extend around the pin and configured to create a locking force to secure the first disc against the middle disc and the second disc against the middle disc.

7. The system of claim 1, further comprising:

a third set of teeth extending from the middle disc about a top surface; and a fourth set of teeth extending from the middle disc about a bottom surface;

wherein the first set of teeth and the third set of teeth rotatably engage with each other and retain the first disc to the middle disc; and wherein the second set of teeth and the fourth set of teeth rotatably engage with each other and retain the second disc to the middle disc.

8. A method, comprising:

providing the system of claim 1;

adjusting the hand grip at a desired orientation relative to the gun body via the attachment device; and locking the hand grip in position via a locking mechanism.

* * * * *